US009366517B2

(12) United States Patent
Kautz et al.

(10) Patent No.: US 9,366,517 B2
(45) Date of Patent: Jun. 14, 2016

(54) METHOD AND APPARATUS TO DEMILITARIZE MUNITION ENERGETICS

(75) Inventors: David J. Kautz, Williamsville, NY (US); Lawrence R. Culp, Grand Island, NY (US); Mark B. Mitskovski, Buffalo, NY (US)

(73) Assignee: US DEMIL, LLC, Buffalo, NY (US)

( * ) Notice: Subject to any disclaimer, the term of this patent is extended or adjusted under 35 U.S.C. 154(b) by 860 days.

(21) Appl. No.: 13/294,437

(22) Filed: Nov. 11, 2011

(65) Prior Publication Data

US 2012/0259149 A1 Oct. 11, 2012

Related U.S. Application Data

(63) Continuation-in-part of application No. 12/017,669, filed on Jan. 22, 2008, now Pat. No. 8,178,744.

(51) Int. Cl.

| | |
|---|---|
| ***F42B 33/06*** | (2006.01) |
| ***F41J 13/00*** | (2009.01) |
| ***F42D 5/04*** | (2006.01) |

(52) U.S. Cl.

CPC ..... *F42B 33/067* (2013.01); *F41J 13/00* (2013.01); *F42D 5/04* (2013.01)

(58) Field of Classification Search

None

See application file for complete search history.

(56) References Cited

U.S. PATENT DOCUMENTS 4,961,391 A * 10/1990 Mak et al. ..... 110/346
5,006,322 A * 4/1991 Schuetzenduebel et al. . 423/210
5,040,972 A * 8/1991 Kleinhenz et al. ..... 432/72
5,207,176 A * 5/1993 Morhard et al. ..... 110/246
5,423,271 A * 6/1995 Schulze ..... 110/237
5,649,325 A 7/1997 Garrison et al.
5,997,289 A 12/1999 Dover (Continued)

FOREIGN PATENT DOCUMENTS

AU 2005230669 * 10/2005
DE 4344544 * 6/1995

(Continued)

OTHER PUBLICATIONS

EFS file name: 20130212_13-294437_IDS_NPL_cite1. Exhibit 1: Department of the Army Technical Manual, Military Explosives, Sep. 1984.

(Continued)

*Primary Examiner* — Melvin C Mayes
*Assistant Examiner* — Sheng H Davis
(74) *Attorney, Agent, or Firm* — John M. Hammond; Patent Innovations LLC

(57) ABSTRACT

A method of demilitarizing an energetic is disclosed. The method comprises indirectly heating the energetic in a chamber to a temperature below a combustion temperature of the energetic to at least partially decompose the energetic and substantially preclude combustion of the energetic such that the indirect heating produces a decomposition gas, and separating at least a portion of the decomposition gas from the chamber. The method may further comprise monitoring the decomposition gas and/or passing the separated decomposition gas through an air abatement system. The method may further comprise adjusting at least one of the following: the indirect heating of the energetic, the separating of the decomposition gas, the air abatement system, and a residence time of the energetic in the chamber. The energetic may be a bulk energetic.

12 Claims, 4 Drawing Sheets

(56) References Cited

U.S. PATENT DOCUMENTS

| | | | | |
|---|---|---|---|---|
| 6,388,164 | B1 * | 5/2002 | Desmare et al. | 588/318 |
| 6,431,094 | B1 | 8/2002 | Gregg | |
| 7,204,182 | B2 | 4/2007 | Bouldin | |
| 2005/0204969 | A1 * | 9/2005 | Capote et al. | 110/341 |
| 2007/0144637 | A1 | 6/2007 | Fujiwara et al. | |
| 2008/0147241 | A1 * | 6/2008 | Tsangaris et al. | 700/273 |
| 2009/0044692 | A1 * | 2/2009 | Ivany et al. | 86/50 |
| 2009/0095146 | A1 | 4/2009 | Fujiwara et al. | |

FOREIGN PATENT DOCUMENTS

| | | | |
|---|---|---|---|
| DE | 04344544 | A1 | 6/1995 |
| DE | 019954234 | * | 6/2000 |
| DE | 102004008621 | A1 | 9/2005 |
| JP | 353125910 | * | 11/1978 |
| JP | 2004012048 | A1 | 7/2005 |
| JP | 2005112420 | A1 | 1/2006 |
| WO | 2005068932 | A1 | 7/2005 |
| WO | 2006112181 | A1 | 10/2006 |

OTHER PUBLICATIONS

EFS file name: 20130212__13-294437__IDS__NPL__cite2. Exhibit 2: Sources Sought Notice—US Army, Army Contracting Command, Joint Munitions and Lethality Contracting Center, Picatinny Arsenal, Jul. 1, 2009.

EFS file name: 20130212__13-294437__IDS__NPL__cite3. Exhibit 3: Applied Technology Solutions Website, http://www.uxb.com/pp./solutions.html.

EFS file name: 20130212__13-294437__IDS__NPL__cite4. Exhibit 4: PIKA Website, http://www.pikainc.com/technologies.html.

EFS file name: 20130212__13-294437__IDS__NPL__cite5. Exhibit 5: Plexus Scientific Website, http.//www.plexsci.com/solutions/environmental-remediation/.

EFS file name: 20130212__13-294437__IDS__NPL__cite6. Exhibit 6: FRTR Remediation Technologies Screening Matrix and Reference Guide website, http.//www.frtr.gov/matrix2/section4/4-22.html.

EFS file name: 20130212__13-294437__IDS__NPL__cite7. Exhibit 7: Draft Environmental Assessment Report for the Ordnance Reef Project prepared for Department of the Army, excerpt, Mar. 2011.

EFS file name: 20130212__13-294437__IDS__NPL__cite8. Exhibit 8: Army Solicitation for Thermal Treatment of Various CADs/PADs, May 13, 2010.

EFS file name: 20130212__13-294437__IDS__NPL__cite9. Exhibit 10a: Abstract of report, "Decontamination of Explosives-Contaminated Range Scrap etc." Department of Defense Environmental Security Technology Certification Office, Mar. 26, 2008.

EFS file name: 20130212__13-294437__IDS__NPL__cite10. Exhibit 10b: Letter from Attorneys of Harter Secrest & Emery LLP to ARA, Inc. regarding U.S. Demil, LLC Intellectual Property Matters.

EFS file name: 20130212__13-294437__IDS__NPL__cite11. Exhibit 10c: Environmental Assessment and Draft finding of No Significant Impact at Ordnance Reef prepared for Department of the Army, Mar. 2011.

EFS file name: 20130212__13-294437__IDS__NPL__cite12. Exhibit 11: EUGRIS website on Hot Gas Decontamination and Open Burning processes, Oct. 3, 2011.

EFS file name: 20130212__13-294437__IDS__NPL__cite13. Harper International Corporation sales brochure, "Dramatic Innovations on Graphite Furnace Technology," copyright 2001.

EFS file name: 20130212__13-294437__IDS__NPL__cite14. Harper International Corporation technical/sales information on rotary tube furnaces, url=http://www.harperintl.com/rotary.htm; printed to pdf Jul. 30, 2008, copyright 2005.

EFS file name: 20130212__13-294437__IDS__NPL__cite15. United States Department of the Army Document TM 9-1300-277, excerpt regarding APE 1236 Deactivation Furnace, 6 pages, Mar. 1982.

EFS file name: 20130212__13-294437__IDS__NPL__cite16. International Search Report in PCT application US 2008/088591. The Report has been annotated to indicate errors the applicant believes were made in citing two Japanese patents.

* cited by examiner

METHOD AND APPARATUS TO DEMILITARIZE MUNITION ENERGETICS

CROSS-REFERENCE TO RELATED PATENT APPLICATIONS

This application is a Continuation-in-Part of copending U.S. patent application Ser. No. 12/017,669, filed on Jan. 22, 2008, the disclosure of which is incorporated herein by reference.

BACKGROUND

1. Technical Field

Apparatus and methods for deactivating spent and unspent munitions and incendiary devices, such that its constituents can be recovered/recycled or disposed of responsibly.

2. Description of Related Art

In the defense of our nation, most projectile weaponry is deployed in a state of readiness, but not actually used. Projectile weaponry includes munitions (ordnance) such as missiles, rockets, grenades, bombs, mines, artillery shells, flares, fireworks, and cartridges (also known as small arms munitions or bullets). All of these munitions and incendiary devices contain high energy materials such as propellants and/or explosives that combust (using self-supplied oxygen) or detonate at a very high rate.

In a military conflict, the desired reliability of the munitions is 100 percent. Thus the propellants and/or explosives should always perform their desired functions in the munitions. However, it is known that these high energy chemical materials degrade over time, and thus their reliability decreases to an unacceptable level. The chemical based propellants and/or explosives of the munitions have a specific "shelf life" that is determined by time and ambient physical conditions. When the shelf life or reliability of a given munition is questionable, it is withdrawn from active stock and replaced with a new munition. Furthermore, spent munition casings, although discharged, may contain remnants of energetic material that can pose harm.

This results in a problem in that these withdrawn "live" and spent munitions with dangerous high energy materials ("energetics") and other hazardous materials, such as lead, mercury etc., must be "demilitarized," i.e. rendered to a state where they are no longer capable of being used as a munition or pose a danger. In order to accomplish this, the energetics must be destroyed, and any remaining munitions materials must be recycled or disposed of in a safe and environmentally responsible manner. It is clearly unacceptable to simply dump munitions that have been withdrawn from service into a landfill, or to sell them and risk their being acquired by criminals or our enemies.

In certain embodiments, the present invention is a method and apparatus for the safe and environmentally responsible demilitarization of "conventional" munitions such as missiles, rockets, grenades, bombs, mines, artillery shells, flares, fireworks, and cartridges (also known as small arms munitions or bullets) comprised of casings, high energy materials, and projectiles. In certain embodiments, the present invention is directed to the demilitarization of "small caliber" munitions, i.e. of fifty caliber or less in size.

The disposal of conventional munitions has evolved as the technology of munitions has developed. For centuries, aged or defective gunpowder was simply disposed of or ignited. When smokeless gunpowder was developed, it was disposed of in a similar manner. With the advent of more sophisticated energetics contained within large caliber munitions and incendiary devices, such as explosive artillery shells, torpedoes, and the like, the historic method of "open burning" was modified by the use of "booster" explosive charges to become "open detonation." Open Burn/Open Detonation (OBOD) was for decades considered to be the fastest and cheapest method of munitions disposal. Significant problems with OBOD were operational safety and severe environmental (air, soil and water) contamination.

The United States armed forces continued aggressive use of OBOD until the mid-1970's when regulations of the Environmental Protection Agency (EPA) were promulgated. As the environmental regulations began to impact the use of traditional OBOD, the U.S. Army adapted the use of a rotary kiln incinerator from the hazardous waste disposal industry, which in turn had adapted it from the cement industry. This device was finalized as the APE (Ammunition Peculiar Equipment) 1236, which is currently in use.

The APE 1236 has operational shortcomings involving safety, process rates and environmental emissions resulting from incineration. However, it is considered the Best Available Technology (BAT), and is therefore permitted by the Environmental Protection Agency as an incinerator to be operated until it is superseded by an improved process technology. In the last several years, the major suppliers of conventional munitions disposal services to the Department of Defense have each put forward their concepts of the next generation BAT. To the best of the applicant's knowledge, the best emerging technologies are the Cryogenic Freezing process of the General Atomics Company of San Diego Calif., and the Donovan Blast Chamber technology of the CH2M Hill Company of Denver Colo. These technologies, as well as the APE 1236 technology are all premised on ultimately directly incinerating or detonating the energetic materials contained within the munition. All three technologies have certain disadvantages, including slow rates of processing, energy utilization inefficiencies, highly problematic and costly unintentional detonations with associated safety risks to operating personnel, and/or challenges in meeting federal and state environmental laws and material legacy (hazardous waste) management/disposal issues.

Accordingly, there remain operational shortcomings within these new concepts. What is needed is a method and apparatus for the demilitarization of munitions which can be operated in a manner that is safe for operating personnel, environmentally beneficial, that does not result in the generation of gaseous, liquid, or solid pollutants that are discharged to the atmosphere or to waterways or land, and that can be operated with a satisfactory rate of throughput. It is desirable that the demilitarization process results in a maximum amount of recyclable/reusable material and a minimal amount of waste to be discharged, with any such waste being harmless to the environment.

SUMMARY

The present invention meets this need by providing a non incinerative ("Decineration") method and apparatus for the demilitarization of conventional munitions. The apparatus is comprised of an elongated tubular munitions conveying chamber having a wall with inner and outer surfaces, an inlet opening, and a discharge opening; a heater in thermal communication with the elongated tubular chamber; and a first discharge barrier obstructing at least a first portion of the discharge opening of the elongated tubular chamber.

The apparatus is provided with means for conveying munitions from the inlet opening of the chamber to the discharge opening of the chamber. In one embodiment, the elongated tubular chamber is rotatable around a longitudinal axis thereof and may have a downward incline from the inlet opening to the discharge opening. The elongated tubular chamber is preferably cylindrical in this embodiment, and is rotated about the central axis thereof. The means for conveying munitions in this embodiment is thus comprised of a drive that rotates the cylinder, and a support that may incline the cylinder downwardly from the inlet opening to the discharge opening. In operation, munitions that are delivered into the inlet opening of the chamber thus advances along the wall of the chamber toward the discharge opening of the chamber as the chamber is rotated.

The apparatus may include a first inlet barrier obstructing at least a portion of the inlet opening of the elongated tubular chamber and/or a second discharge barrier obstructing a second portion of the discharge opening of the elongated tubular chamber not obstructed by the first discharge barrier.

The first discharge barrier may be disposed outside of the elongated tubular chamber and proximate to the discharge opening of the elongated tubular chamber. The first discharge barrier may be formed of a heavy plate of material. Alternatively, the first discharge barrier may be an obstruction grating disposed outside of the elongated tubular chamber and proximate to the discharge opening of the elongated tubular chamber. The obstruction grating may be comprised of a plurality of angle irons joined to a framework.

Alternatively or additionally, the first discharge barrier may be comprised of a helical baffle joined to the inner surface of the wall of the elongated tubular chamber, or a plurality of radially inwardly disposed plates joined to the inner surface of the wall of the elongated tubular chamber. In either of these embodiments, the first discharge barrier may also be a part of the means for conveying munitions from the inlet opening of the chamber to the discharge opening of the chamber, with it being unnecessary to provide a downward incline from the inlet opening to the discharge opening.

The apparatus may be supplied with munitions to be demilitarized by a material feeding device in communication with the inlet opening of the elongated tubular chamber. The apparatus may also include a material discharge device in communication with the discharge opening of the elongated tubular chamber. A material separator may also be provided to separate the solids discharged from the tubular chamber into separate material streams for maximized recovery/recycling or responsible disposal.

The apparatus is preferably further provided with an exhaust for discharge of gases produced by the decomposition ("Decineration") of the energetic material(s) in the munitions, and an air abatement system for treating any discharged gases, aerosols, soot, or other particulates contained therein.

In general, munitions to be demilitarized with the apparatus and method of the present invention are comprised of casing material, at least one energetic material (also referred to herein as an "energetic"), and projectile material. The method of the present invention is comprised of delivering the munitions into an elongated tubular chamber having a wall, an inlet opening, and a discharge opening; providing a first discharge barrier obstructing at least a portion of the discharge opening of the chamber; conveying the munitions along the elongated tubular chamber in a direction from the inlet opening toward the discharge opening; and heating the munitions within the chamber to a temperature sufficient to cause decomposition ("Decineration") of the energetic material into at least one gas. Where the energetic material of the munition violently decomposes and causes motion of a fragment of the munition, the method further includes obstructing the motion of the fragment with the first discharge barrier. The method may further include providing a first inlet barrier obstructing at least a portion of the inlet opening of the chamber, and obstructing the motion of a fragment with the first inlet barrier.

The method may further include discharging the casing material and the projectile material from the discharge opening of the chamber to a discharge device. The casing material and the projectile material may be separated into different streams for different recycling options or disposal processes. The method preferably further includes removing the gas generated by the energetic material decomposition from the tubular chamber through an exhaust, and abating any constituents in the gas with an appropriate abatement device as prescribed by environmental regulations.

In accordance with the invention, there is also provided a method of demilitarizing an energetic. The method comprises indirectly heating the energetic in a chamber to a temperature below a combustion temperature of the energetic to at least partially decompose the energetic and substantially preclude combustion of the energetic such that the indirect heating produces a decomposition gas, and separating at least a portion of the decomposition gas from the chamber. The method may further comprise monitoring the decomposition gas and/or passing the separated decomposition gas through an air abatement system. The method may further comprise adjusting at least one of the following: the indirect heating of the energetic, the separating of the decomposition gas, the air abatement system, and a residence time of the energetic in the chamber. The energetic may be a bulk energetic.

BRIEF DESCRIPTION OF THE DRAWINGS

The invention will be described by reference to the following drawings, in which like numerals refer to like elements, and in which.

Figure 1:
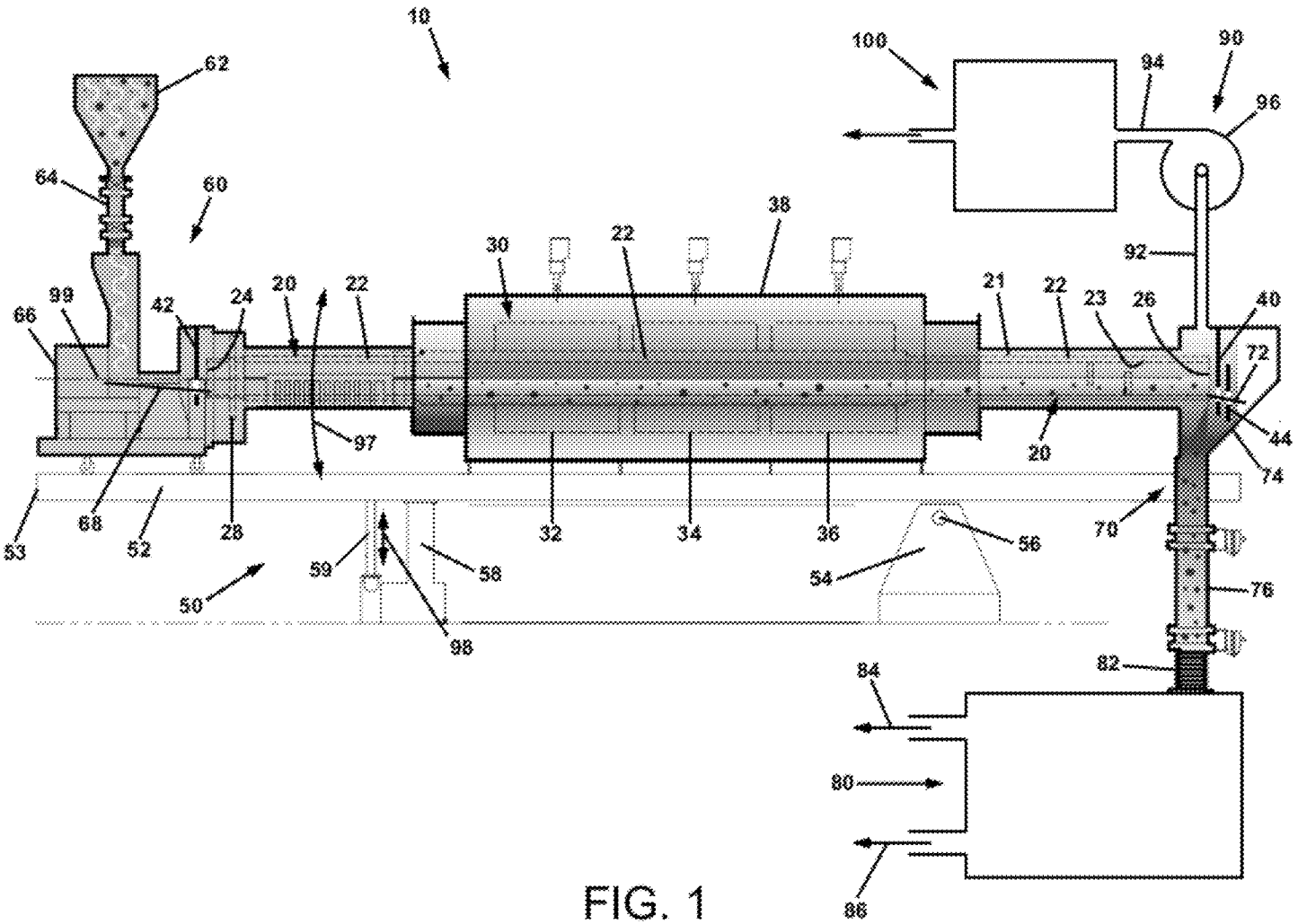
FIG. 1 a schematic illustration of an exemplary apparatus of the present invention for demilitarization of munitions.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. Standard terminology is widely used in munitions demilitarization art. Accordingly, in describing the present invention, a variety of terms are used in the description.

As used herein, the term "caliber" is meant to indicate the interior diameter of the barrel of weapon or a gun (also known as a firearm) in hundredths of an inch or millimeters; the term is also used herein with reference to munitions, and generally refers to the approximate outside diameter of the projectile of the munition, or is meant to indicate munitions that are useable in a particular caliber of weapon.

As used herein, the term "cartridge/shell" is meant to indicate an assembled munition that is loadable into a gun or weapon. A cartridge/shell is comprised of a casing, an energetic material, and a projectile. The casing is typically a metallic cylinder open at one end, contains the energetic material. The open end of the casing is sealed to the proximal end of the projectile. The distal end of the projectile is typically of an aerodynamic shape.

As used herein, the term "energetics" or "energetic materials" is meant to indicate a material in a munition that contains a large amount of chemical energy and that is either used to propel the projectile of the munition out of the barrel of a gun or weapon or to deliver a destructive end result to its target. The materials are generally classified broadly as "primers," the highly exothermic decomposition of which is typically set off by the action of a weapon trigger or fuze; propellants, which provide the high energy to separate the projectile from the casing and discharge it from the barrel of the weapon at high velocity; and "main charge" (also known as "filler", "booster", "bursting", etc.) which is what supplies the destructive energy at the target. Munitions or munition components may have any one, two or all three categories of energetics in their assembly.

As used herein, the term "demilitarization," when used with respect to munitions, is meant to indicate actions performed on the munitions to render them inoperative, and thus unsuitable for their original intended purpose and posing no further threat of physical harm.

Figure 2:
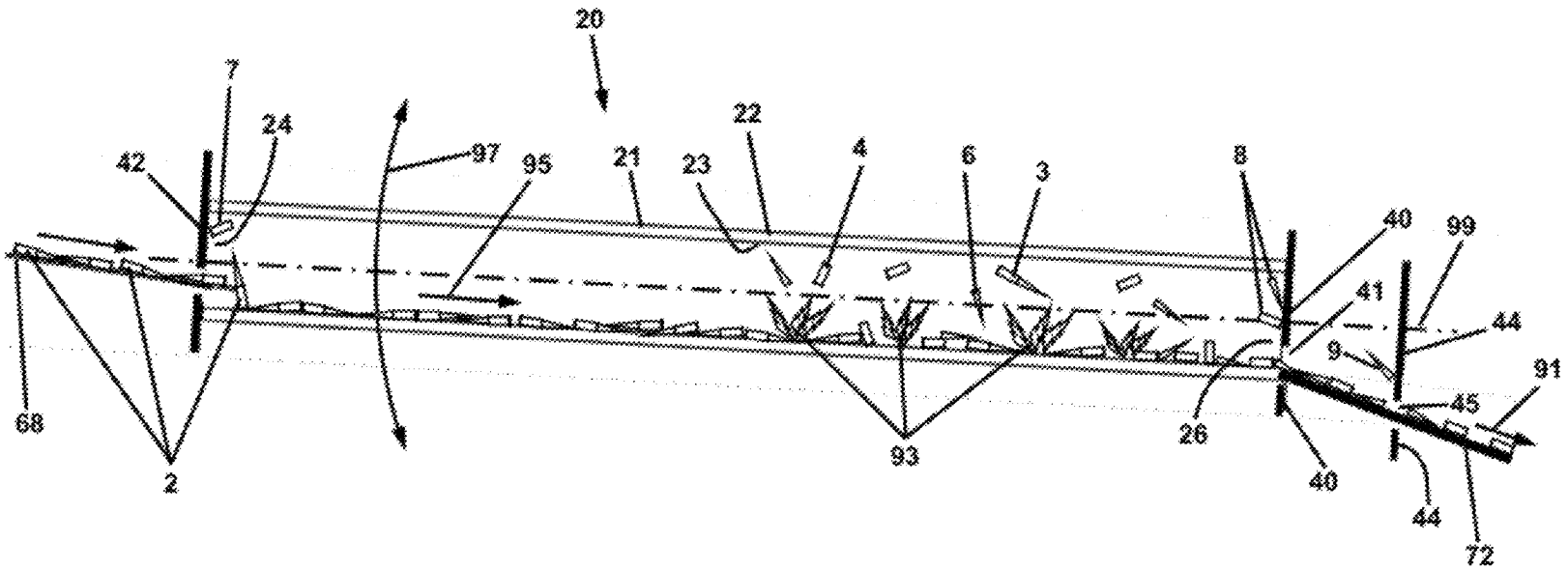
FIG. 2 is a more detailed schematic illustration of one elongated tubular munitions conveying chamber, and inlet and discharge opening barriers of the apparatus of FIG. 1.

FIG. 1 is a schematic illustration of an exemplary apparatus of the present invention for demilitarization of munitions, and FIG. 2 is a more detailed schematic illustration of one elongated tubular munitions conveying chamber, and inlet opening barrier and discharge opening barriers of the apparatus of FIG. 1.

Referring first to FIG. 1, apparatus 10 is comprised of an elongated tubular munitions conveying chamber 20 having a wall 22 with an inner surface 21 and an outer surface 23, an inlet opening 24, and a discharge opening 26. A heater 30 is provided in thermal communication with the elongated tubular chamber 20, for the purpose of heating the space and contents within the chamber 20. Heater 30 may be an electric heater, or a fuel-fired heater, such as by natural gas or other fuel. Alternatively, heater 30 may be supplied a heated heat transfer fluid from an external source (not shown), with the heat therein being transferred to tubular chamber 20. By "thermal communication" between heater 30 and tubular chamber 20, it is meant that heat energy is transferred from heater 30 to tubular chamber 20 by convection and/or conduction and/or radiation. It is not necessary that heater 30 be in direct contact with wall 22 of tubular chamber 20 in order to heat the wall 22 and the contents therein. Additionally, heater 30 may be comprised of a plurality of subzone heaters such as subzone heaters 32, 34, and 36. Each of subzone heaters may be set at a different temperature for precise control of the overall temperature profile from the inlet opening 24 to the discharge opening 26 of the tubular chamber 20. Heater 30 is preferably housed within an enclosure 38, which includes structural walls and thermal insulation (not shown).

The apparatus 10 may be further comprised of a first discharge barrier 40 obstructing at least a first portion of the discharge opening 26 of the elongated tubular chamber 20. The apparatus 10 may also include a first inlet barrier 42 obstructing at least a portion of the inlet opening 24 of the elongated tubular chamber and/or a second discharge barrier 44 obstructing a second portion of the discharge opening 26 of the elongated tubular chamber 20 not obstructed by the first discharge barrier 40.

The first discharge barrier 40 may be disposed outside of the elongated tubular chamber 20 and proximate to the discharge opening 26 of the elongated tubular chamber 20. The first discharge barrier may be formed of a heavy plate of material as indicated in FIG. 2. Alternatively, the first discharge barrier 40 may be an obstruction grating disposed outside of the elongated tubular chamber 20 and proximate to the discharge opening 26 of the elongated tubular chamber 20. The obstruction grating is formed by a series of rows and/or columns of impact-resistant material such that from any point within the tubular chamber 20, there is no straight line path out of the tubular chamber.

Figure 3C:
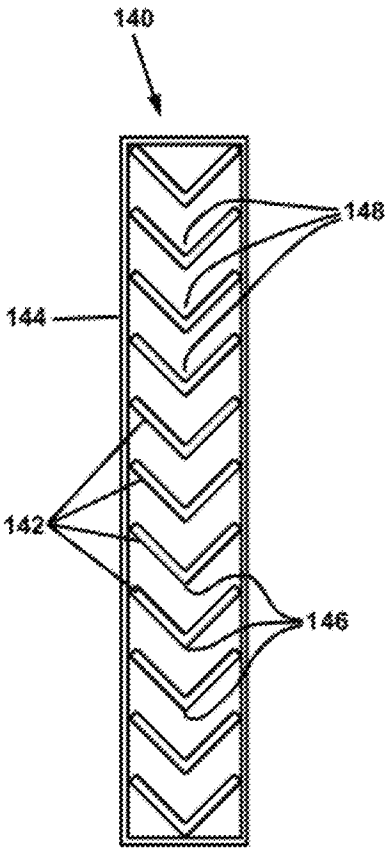
FIG. 3C is a cross-sectional view of the obstruction grating of FIG. 3B, shown in an inverted position.
Figure 3B:
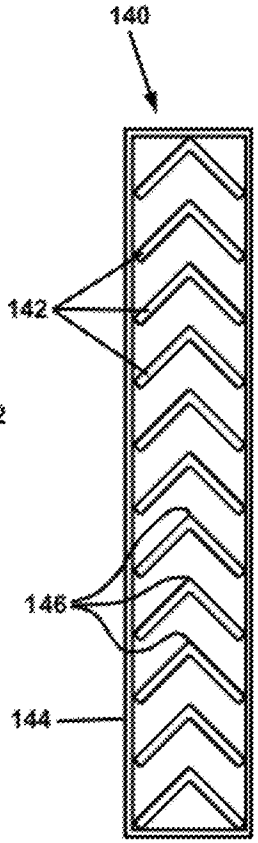
FIG. 3B is a cross-sectional view of the obstruction grating of FIG. 3A, taken along line 3B-3B of FIG. 3A.
Figure 3A:
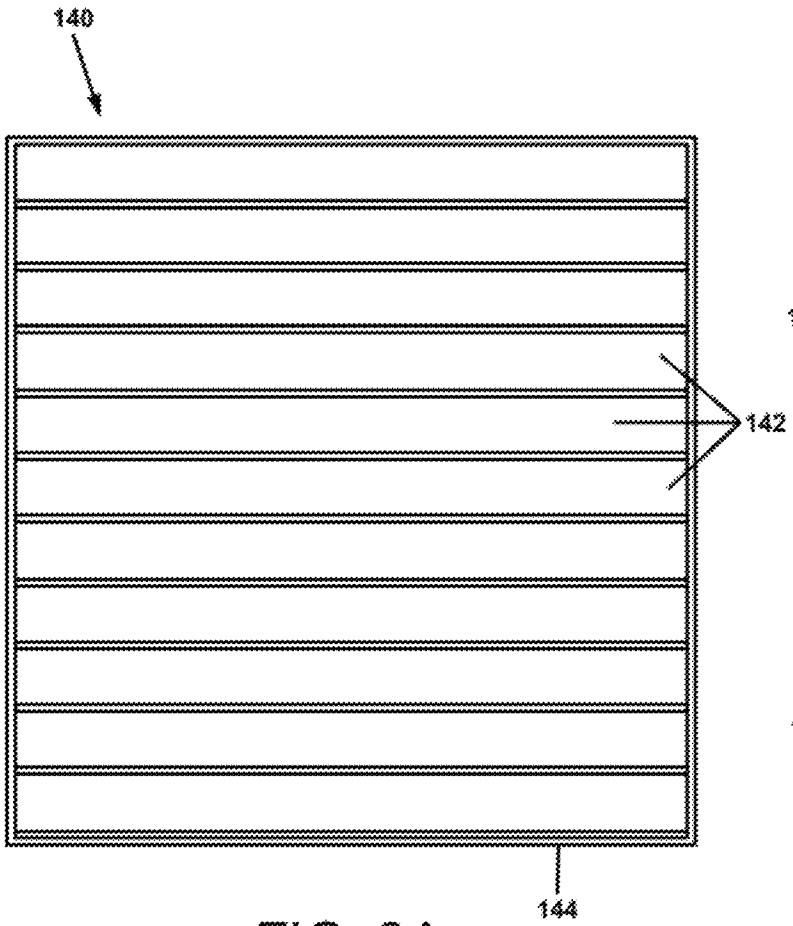
FIG. 3A is an end view of an alternative discharge barrier of the apparatus formed as an obstruction grating.

FIGS. 3A-3C depict one embodiment of a suitable obstruction grating. Referring first to FIGS. 3A and 3B, the obstruction grating 140 is comprised of a plurality of angle irons 142 joined to a framework 144. (It is to be understood that the term "angle iron" is not meant to limit the material of elements 142 to being made of iron or steel, but rather to simply indicate a readily available L-shaped structure formed by two flat strips of material intersecting at an apex.)

In one embodiment, the obstruction grating may be oriented as shown in FIG. 3B, with the apices 146 of the angle irons 142 oriented upwardly. Fragments of munitions that impact any of the angle irons 142 will simply fall downwardly and be conveyed onward through the apparatus. In another embodiment, the obstruction grating may be oriented as shown in FIG. 3C, with the apices of the angle irons 142 oriented downwardly. Some fragments of munitions that impact the angle irons 142 may accumulate in the troughs 148 formed by the angle irons. These accumulated fragments will reduce and eliminate the velocities of subsequent fragments of munitions that impact the obstruction grating 140, so that they exit the obstruction grating without any velocity. In either case, it can be seen that there is no direct path for fragments of munitions to pass horizontally through the obstruction grating 140 without striking at least one, and likely two angle irons 142.

It will be apparent that the aforementioned first inlet barrier 42 and/or the second discharge barrier 44 may either be plates of material, or obstruction gratings as described above.

Figure 4:
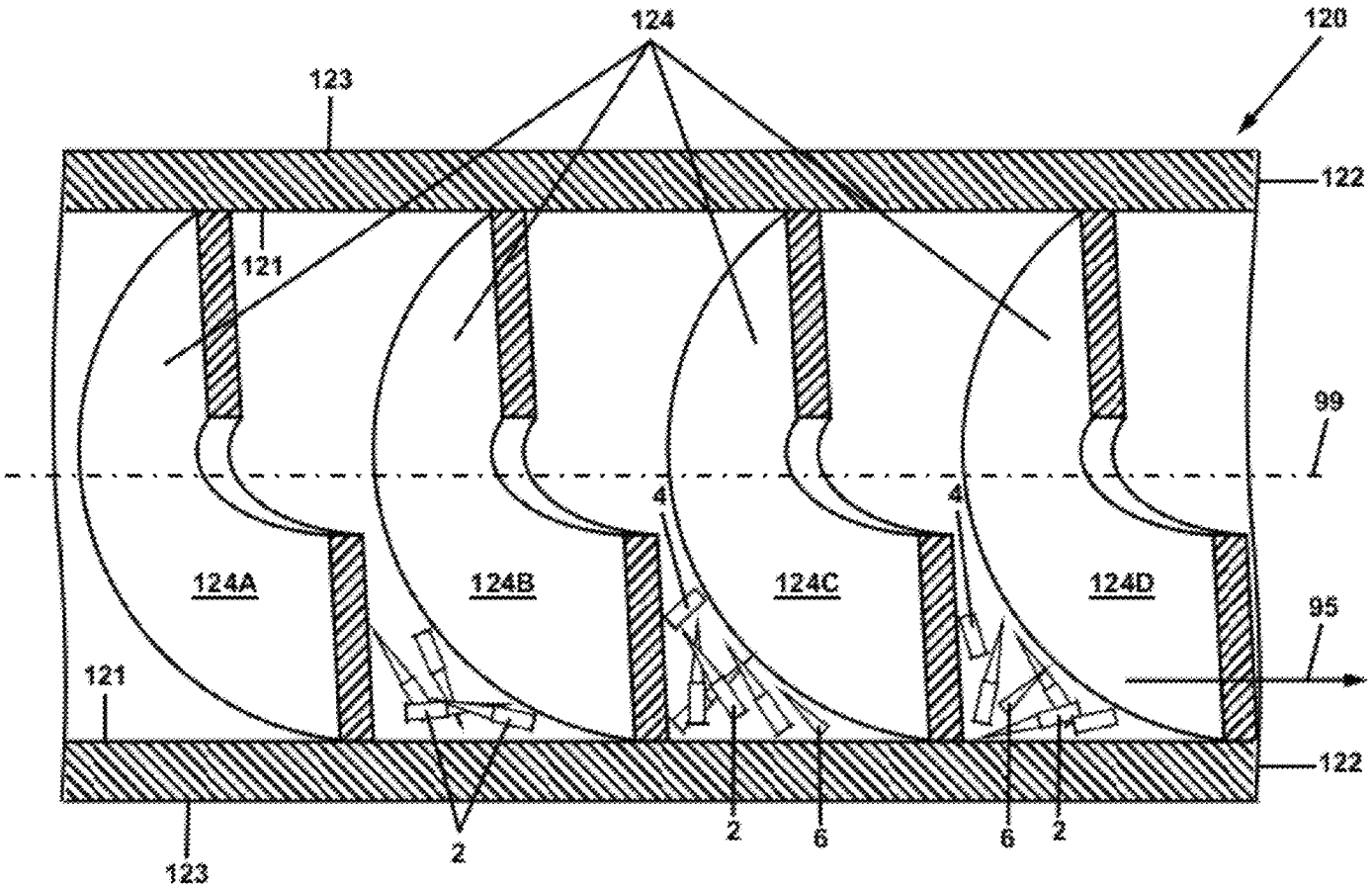
FIG. 4 is a lengthwise cross-sectional view of an alternative elongated tubular munitions conveying chamber comprised of a helical baffle joined to the inner surface of the wall thereof.

In an alternative embodiment, the first discharge barrier of the elongated tubular chamber may be comprised of a helical baffle joined to the inner surface of the wall of the elongated tubular chamber. FIG. 4 is a lengthwise cross-sectional view of a section of such an alternative elongated tubular munitions conveying chamber. The chamber 120 is comprised of a wall 122 with an inner surface 121 and an outer surface 123, and an inlet and discharge openings not shown, but as described for chamber 20 of FIG. 1. The chamber 120 is further comprised of a helical baffle 124 joined to the inner surface of the wall thereof by suitable means such as by welding. The helical baffle 124 is formed as a continuous spiral of material, i.e. portion 124A continues around the inner surface 121 of the wall 122 and is contiguous with portion 124B, portion 124B continues around the inner surface 121 of the wall 122 and is contiguous with portion 124C, etc.

It can be seen that a continuous helical trench is formed between successive portions 124A, 124B, 124C, etc. of the helical baffle 124. Thus, during munitions processing with the apparatus, when munitions 2 ruptures violently and separates into casings 4, projectiles 6, and fragments thereof moving at high velocity, those objects are unable to fly axially along chamber 120 because they are immediately blocked by the helical baffle 124. Thus the helical baffle 124 functions as a first discharge barrier for the apparatus.

In a further embodiment (not shown), the continuous helical trench may be "boxed in," either by joining a spiral sheet of material to the inner edge of the helical baffle to form a roof over the helical trench, or by providing a cylindrical pipe or rod up through the open center of the tubular chamber, such that the pipe or rod occupies the space of the open center and forms a roof over the helical trench. In this embodiment, the resulting passageway through the elongated tubular chamber is a helical passageway having a rectangular cross-section. In another embodiment (not shown), instead of forming the helical passageway within a cylindrical tube and having a rectangular cross-section, the helical passageway may be made by forming a heavy-walled cylindrical tube into a helical coil or "corkscrew" shape. For either of these embodiments having a helical passageway, when munitions rupture violently in the passageway, the only path for resulting high velocity munitions fragments to advance axially along the passageway is to move in a helical trajectory bounded by the passage walls. The kinetic energy of any such high velocity fragments will quickly be dissipated/eliminated within the passageway.

In an alternative embodiment, the first discharge barrier may be comprised of a plurality of radially inwardly disposed plates joined to the inner surface of the wall of the elongated tubular chamber. In this embodiment, instead of having a continuous helical baffle 124, the chamber may include individual radially inwardly disposed plates 124A, 124B, 124C, etc. The plates may extend along a shorter sector of the inner surface 121 of wall 122 than shown, and may have a lower or higher density and a less ordered arrangement than shown in FIG. 4. It is preferable that the plates 124A, 124B, 124C have a pitch with respect to the central axis 99 of the chamber 120, so that in operation, when chamber 120 is rotated, the munitions will be conveyed axially as indicated by arrow 95.

It is noted that in either of these embodiments, the first discharge barrier formed either by a helical baffle or by pitched radially inwardly disposed plates may also be a part of the means for conveying munitions from the inlet opening of the chamber to the discharge opening of the chamber, with it being unnecessary to provide a downward incline from the inlet opening to the discharge opening. It is also noted that for an added measure of safety, the apparatus may be provided with the previously described plate or obstruction grating barriers at the discharge and/or the inlet openings of the elongated tubular chamber.

Referring again to FIG. 1, and also to FIG. 2, the apparatus 10 is provided with means for conveying munitions from the inlet opening 24 of the chamber 20 to the discharge opening 26 of the chamber 20 during the operation thereof. In one embodiment depicted in FIG. 1 and FIG. 2, the elongated tubular chamber 20 is rotatable around a longitudinal axis 99 thereof and has a downward incline from the inlet opening 24 to the discharge opening 26. (For clarity of illustration, the relative amount of incline of chamber 20 is exaggerated in FIG. 2.) The elongated tubular chamber 20 is preferably cylindrical in this embodiment, and the longitudinal axis of rotation 99 is the central axis of chamber 20. In this embodiment, the means for conveying the munitions is comprised of a drive gear 28 and motor (not shown) that rotates the cylinder 20, and a support assembly 50 that supports and inclines the cylinder 20 downwardly from the inlet opening 24 to the discharge opening 26.

Support assembly 50 is comprised of a platform 52 that supports the tubular chamber 20, the heater enclosure 38, and other subassemblies of the apparatus 10. Support assembly 50 is further comprised of a fulcrum base 54, a fulcrum pin 56, a level column 58, and a jack 59. Jack 59 is extendable and retractable as indicated by bidirectional arrow 98, such that when jack 59 is extended, the distal end 53 of platform 52 is raised and lowered. Platform 52 and tubular chamber 20 rotate around fulcrum pin 56 as indicated by arcuate arrow 97, so that when jack 59 is extended upwardly, tubular chamber 20 is moved into an inclined position. In operation, munitions that are delivered into the inlet opening 24 of the chamber 20 thus advances along the wall 22 of the chamber 20 toward the discharge opening 26, as the chamber 20 is rotated.

The apparatus 10 may be supplied with munitions to be demilitarized by a material feeding device 60 in communication with the inlet opening 24 of the elongated tubular chamber 20. The feeding device 60 is used to deliver the munitions into the tubular chamber 20. Device 60 can be any material moving device such as an inclined chute, a vibrating feed conveyor or a belt or pan type conveyor. It is desirable that it be metallic and placed at such a location that if any potential fragment of material (e.g. a bullet or casing) exited the inlet opening 24 of the tubular chamber 20, the trajectory path will impact some portion of the feeding device 60, hindering the object from exiting and reaching any operator station, if it did not impact the inlet barrier 42. In the embodiment depicted in FIG. 1, which is meant to be illustrative and not limiting, material feeding device 60 is comprised of a hopper 62 for receiving and holding the munitions to be demilitarized, an airlock 64 to prevent escape of decomposition gases during operation, a lower housing 66, and an inclined chute 68 in communication with the inlet opening 24 of tubular chamber 20.

The apparatus may also include a material discharge device 70 in communication with the discharge opening 26 of the elongated tubular chamber 20. The discharge device 70 is used to receive the demilitarized munitions from the discharge end 26 of tubular chamber 20. Material discharge device 70 can be any material moving device such as an inclined chute, a vibrating feed conveyor, or a belt or pan type conveyor. It is preferable that device 70 be metallic in order to withstand the normal physical scouring (wear and tear) of demilitarized munition fragments that are discharged from tubular chamber 20. It is also preferable that any inclined chute, such as chute 72 of FIGS. 1 and 2 be placed at such an angle that chute 72 fits through the respective holes or slots 41 and 45 in the blast barriers 40 and 44 at the discharge opening 26 of the tubular chamber 20. In the embodiment depicted in FIG. 1, material discharge device 70 is further comprised of a hopper 74 for receiving the demilitarized munitions and an airlock 76 to prevent escape of decomposition gases during operation.

A material separator 80 may also be provided to separate the solids discharged from the tubular chamber 20 into separate material streams for maximized recovery/recycling or responsible disposal. Material separator 80 may be coupled to material discharge device 70 via a flex coupling 82, which flexes as the incline of tubular chamber 20 is adjusted. Material separator 80 may be used to separate the brass casings, bullets and other materials into different streams 84 and 86 to increase the value of these materials for recycle. If the munition is comprised of ferrous material, (such as bullets with steel jackets) or plastics, paper etc., material separator 80 may include magnetic, eddy current and air separation means (not shown).

The apparatus is preferably further provided with an exhaust 90 for removal of gases produced by the decomposition of the energetic material(s) in the munitions from both the apparatus 10, and from the facility in which the apparatus 10 is installed. Exhaust 90 may be comprised of exhaust ducts 92 and 94, and exhaust blower 96. Although exhaust 90 is depicted as being connected to apparatus 10 near the discharge opening 26 of tubular chamber 20, the connection may also be made near the inlet opening 24.

Exhaust 90 is preferably connected to an air abatement system 100 for treating any regulated exhaust gas streams. It is to be understood that although the products of decomposition of the energetic materials are referred to herein as gases, this is not to be construed as being only materials in the gas phase. The decomposition products may include solid particulates such as soot, and liquid particulates such as aerosol droplets, which are entrained in the exhaust gas stream delivered by exhaust 90. Accordingly, pollution abatement system 100 may include one or more of a particulate filter, a fume scrubber, an incinerator or thermal oxidizer, a condenser, an adsorbent, an absorbent, (all not shown) and/or other well known separation or destruction means used to abate any regulated gas streams. In general, the gas abatement system 100 enables the demilitarization apparatus 10 to meet the requirements of federal, state, and local environmental laws and regulations, but is not required for the functioning of the apparatus 10. The relative complexity of the abatement system 100 will depend upon the combination of environmental laws and regulations to be satisfied.

In general, and referring to FIG. 2, munitions 2 to be demilitarized with the apparatus and method of the present invention are comprised of casing material, at least one energetic material, and projectile material. Referring again to both FIGS. 1 and 2, the method of the present invention is comprised of delivering the munitions into an elongated tubular chamber 20 having a wall 22, an inlet opening 24, and a discharge opening 26; providing a first discharge barrier 40 obstructing at least a portion of the discharge opening 26 of the chamber 20 (or a first discharge barrier 124 internal to the elongated tubular chamber 120 of FIG. 4 as described previously herein); conveying the munitions 2 along the elongated tubular chamber 20 in a direction from the inlet opening 24 toward the discharge opening 26 as indicated by arrow 95; and heating the munitions within the chamber to a temperature sufficient to cause decomposition (Decineration) of the energetic material into at least one gas. The placement of the munitions 2 onto the inclined chute 68 or other feed device may be done either by hand, or by an automated device such as material feed device 60 described previously herein.

Where the energetic material of the munitions violently decomposes as indicated by ruptures 93 and causes motion of whole cartridges 3, casings 4, projectiles 6, or fragments 8 thereof, the method further includes obstructing the motion of the fragments 8 with the first discharge barrier 40 or the first discharge barrier 124 of FIG. 4. The method may further include providing a first inlet barrier 42 obstructing at least a portion of the inlet opening 24 of the chamber 20, and obstructing the motion of a fragment 7 with the first inlet barrier 42. Because the motion of separated casings, projectiles, and fragments thereof resulting from violent decompositions of energetic material is somewhat random, on some occasions, a fragment 9 may be ejected through the discharge hole 41 in first discharge barrier 40. Because of the potential danger posed by such a high energy ejected fragment 9, a second discharge barrier 44 is provided to obstruct the motion of ejected fragment 9. Second discharge barrier 44 is positioned such that it obstructs a second portion of the discharge opening 26 of the elongated tubular chamber 20 not obstructed by the first discharge barrier 40.

The method of the present invention preferably further includes discharging the casings 4, projectiles 6, and fragments of material thereof from the discharge opening 26 of the chamber 20 to a discharge device 70, as indicated by arrow 91. The casing material and the projectile material may be separated into different streams 84 and 86 for different recycling or disposal processes by material separator 80. The method preferably further includes removing the gas generated by the energetic material decomposition from the tubular chamber 20 through an exhaust 90, and abating any constituents in the gas with an air abatement device 100 as prescribed by environmental regulations.

More specific preferred attributes and operational details of the applicant's apparatus and method will now be described.

It is desirable that the munitions that has been fed into tubular chamber 20 is aligned as shown in FIG. 2 in its general direction of travel and parallel to the longitudinal axis 99 of the chamber 20, and is disposed in a fairly uniform distribution along on the wall 22 of tubular chamber 20. For most efficient operation, the feed rate to the tubular chamber 20 should be continuous and at a uniform level but that is not required for the applicant's method to work satisfactorily. The tubular chamber 20 should be preheated and maintained at a temperature of between about 350 and about 1,000 degrees Fahrenheit at a point about midway along the length of the tubular chamber 20 prior to the start of processing munitions.

In operating the applicant's apparatus, the residence time of the munitions and the temperature in the tubular chamber 20 are adjusted to particular values depending upon the caliber of the munitions, the munitions temperature to be attained and maintained, and the type of energetic material inside the munitions, in order to ensure complete decomposition of the energetic and demilitarization thereof. The temperature within the chamber 20 is precisely zone controlled by controlling the power delivered to the heater 30. The residence time of the munitions within chamber 20 of the apparatus 10 may be controlled by controlling the rotational speed and the degree of incline of chamber 20. For an apparatus with a tubular chamber 120 that includes a helical baffle 124 as shown in FIG. 4 and described previously herein, the residence time of the munitions within the chamber 120 is a function of only the rotational speed of the chamber and the pitch of the helical baffle 124 (except for a few random pieces of munitions that may be displaced a short distance forward or rearward in the chamber by violent decomposition therein.) For an apparatus with an alternative munitions conveying means, similar speed-related operational control parameters will be apparent.

Complete demilitarization is defined as there being no remaining residual energetic in or on the dis-assembled munitions shells/cartridges, or fragments thereof, in the discharge stream that exits the discharge end 26 of tubular chamber 20. The discharge stream should contain only shells, cartridge casings, projectiles, and fragments thereof, i.e. "cartridge brass and bullets." If assembled cartridges and or energetic remains are exiting the tubular chamber, either the munitions residence time, the temperature, or both should be increased.

It is anticipated that a portion of the energy released from the decomposition of the energetic contained in a munition will be absorbed by the munitions and/or munition components adjacent to that munition within the elongated tubular chamber 20. A portion of the undecomposed munitions proximate to the decomposing munitions that still contain their energetic will gain sympathetic heat from the decomposing munitions, which will aid in the needed temperature rise of the adjacent undecomposed munition. In that manner, the thermal energy released by the demilitarization of the munitions in the proposed equipment should have the desired effect of lowering the heat demanded from the heater 30, thereby making the applicant's apparatus and method more energy efficient.

The applicant's apparatus and method are advantageous with respect to those of the prior art in other aspects as well. In contrast to the aforementioned prior art methods, the applicant's method is directed to the controlled decomposition ("Decineration) of the propellant and primer energetic materials contained in the munitions, performed in a manner that meets the requirements of federal and state regulations, and that can result in the total recycling of remaining components. The controlled decomposition ("Decineration") of the energetic materials results in increased operator safety, complete capture and abatement of all regulated resulting gas streams and full recovery/recycling of remaining materials.

The applicant's preferred apparatus and method differs from the aforementioned APE 1236 apparatus and method in that the applicant's apparatus and method utilize "rotary furnace" technology, while APE 1236 used "rotary kiln" technology. In a rotary kiln, heat is supplied thereto by the combustion of a fuel. The fuel combustion gases are blown into the kiln and are in direct contact during the firing of the contents therein. These combustion gases place an additional load on the air handling system supplying the furnace and the pollution control equipment abating any emissions therefrom. The direct impingement of the flame front on the material being processed leads to undesired chemical compounds being formed, as 1) there is no way to control the decomposition chemistry of the energetic and solids once the material reaches combustion temperatures and 2) the material approaches the temperature of the flame at which point uncontrolled and unwanted chemical and metal reactions take place. This makes it highly difficult to meet government emissions laws and regulations at acceptable material throughput rates. In contrast, the applicant's apparatus and method uses the main component of a rotary furnace, which is an elongated tubular chamber that is heated externally with no direct heat source contact on the munitions materials. The tubular chamber is preferably comprised of a very heavy alloy steel tube. Because of this design, low temperature and lack of direct heat contact with the materials, the air abatement equipment that is connected to the applicant's apparatus operates much more efficiently and handles only the gases produced by the decomposition of the energetic material of the munitions passing through the rotary furnace, and not the larger and more toxic volume of combustion gas that the APE 1236 system produces and must handle. Additionally, because the heating occurs on the exterior of the tubular chamber within the applicant's apparatus, the temperature can be controlled precisely to assure complete decomposition ("Decineration") of munitions at temperatures significantly lower than in the APE 1236 rotary kiln. This also results in a more efficient process operation while enabling the meeting of all government environmental emissions regulations.

The following example of one embodiment of the applicant's apparatus is meant to be illustrative and not limiting. Referring again to FIG. 1, apparatus 10 may be made by performing modifications to a commercially available rotary furnace, such as a multiple zone electric or gas fired rotary tube furnace manufactured by the Harper International Corporation of Lancaster, N.Y. To adapt this furnace for use in the present application, the unit may be ordered with the features of an internal material feed screw (i.e. helical baffle), a variable incline adjustor, a multi zone heating and entry and exit rotary locks. To this unit, one or both of the inlet blast barrier 42 and discharge blast barriers 40 and 44 may be joined to structural members within the furnace such that they function to block any potential ejected munitions fragments as described previously herein.

Within this rotary furnace, both the temperature and residence time may be precisely monitored and controlled independently. This, along with the ability to control the feed rate of products being fed to the furnace enables the complete demilitarization of the munitions. In one embodiment, the temperature within the tubular chamber of the furnace may be maintained between about 350 and about 1000° F., with the residence time of the munitions passing therethrough being around 30 seconds. The tubular chamber of the furnace may have an inside diameter of about twenty (20) to thirty six (36) inches, a wall thickness of about three (3) to four (4) inches, and a length of about twenty (20) to thirty (30) feet. The inside diameter and length are selected for operational considerations (i.e. processing rate and size of munitions) and are not critical for the operability of the invention. The wall thickness is selected for operator safety considerations and is determined by the standard penetration tables established within the munitions community.

A complete emissions monitoring and process control package may be added to the outlet of the furnace which incorporates carbon monoxide and oxygen monitoring as well as automatic feed stream control/shut-off. The exhaust from the furnace may be fed into a specifically designed multi-stage air abatement control system. This system is designed to meet government emissions laws and regulations. The unique design of the system allows the air abatement control equipment to operate more efficiently and at significantly lower temperatures than any competing technology known to the applicant. The system may be operated in a continuous, steady state mode, and may be operated at a significantly lower temperature as compared to the APE 1236 system, thus reducing the production of undesired energetic and metal material decomposition byproducts during processing. The applicant's preferred apparatus also reduces gas volume to be processed by the air on abatement system 100 by several orders of magnitude.

It is to be understood that although the applicant's apparatus and method described herein are directed to the demilitarization of small caliber munitions, with scaling to a larger apparatus, the apparatus and method are adaptable to larger caliber munitions, aerial bombs, torpedoes, mines, rocket warheads, hand grenades, incendiary devices, etc. Thus any dimensions and related scaling of the apparatus recited herein are to be construed as exemplary and not limiting.

It is, therefore, apparent that there has been provided, in accordance with the present invention, a method and apparatus for the demilitarization of conventional munitions and incendiary devices containing energetics. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of demilitarizing an energetic, the method comprising:

a) delivering the energetic to a chamber in an encased condition;

b) indirectly heating the energetic in the chamber to a temperature below a combustion temperature of the energetic to cause partial decomposition of the energetic in the absence of combustion of the energetic in the chamber, the indirect heating producing a decomposition gas; and c) separating at least a portion of the decomposition gas from the chamber.

2. The method of claim 1, further comprising passing the separated decomposition gas through an air abatement system.

3. The method of claim 2, further comprising monitoring the decomposition gas.

4. The method of claim 2, further comprising monitoring the decomposition gas and adjusting at least one of the indirect heating of the energetic, the air abatement system, and a residence time of the energetic in the chamber.

5. The method of claim 1, wherein the energetic is a bulk energetic.

6. The method of claim 1, further comprising monitoring the decomposition gas.

7. The method of claim 1, further comprising monitoring the decomposition gas and adjusting at least one of the indirect heating of the energetic, the separating of the decomposition gas and a residence time of the energetic in the chamber.

8. The method of claim 1, wherein the energetic is delivered to the chamber in solid phase form.

9. The method of claim 1, wherein the energetic is delivered to the chamber contained within a casing of a munition, and wherein the energetic is in an undiluted condition.

10. The method of claim 1, wherein the chamber is an elongated rotatable tubular chamber formed as a single piece.

11. A method of demilitarizing an energetic, the method comprising:

a) indirectly heating the energetic in a chamber to a temperature below a combustion temperature of the energetic to cause initiation of decomposition of the energetic and production of a decomposition gas in the absence of the combustion of the energetic;

b) measuring the temperature of the decomposition gas;

c) adjusting at least one of the indirect heating of the energetic, and a residence time of the energetic in the chamber so as to adjust the temperature of the decomposition gas to a desired temperature; and d) maintaining the desired temperature of the decomposition gas by controlling at least one of the indirect heating the energetic, and a residence time of the energetic in the chamber to decompose the energetic in the absence of combustion of the energetic in the chamber.

12. The method of claim 11, wherein the maintaining the desired temperature of the decomposition gas in the exhaust maintains the production of the decomposition gas at a constant rate.

* * * * *